US006941917B2

(12) United States Patent
Kawai et al.

(10) Patent No.: US 6,941,917 B2
(45) Date of Patent: Sep. 13, 2005

(54) CONTROL SYSTEM FOR INTERNAL COMBUSTION ENGINE AND METHOD

(75) Inventors: Takashi Kawai, Susono (JP); Hiroshi Tsujii, Mishima (JP); Ken Kuretake, Mishima (JP); Masanori Sugiura, Toyota (JP); Hideto Hanada, Yokohama (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 146 days.

(21) Appl. No.: 10/211,557

(22) Filed: Aug. 5, 2002

(65) Prior Publication Data

US 2003/0037748 A1 Feb. 27, 2003

(30) Foreign Application Priority Data

Aug. 22, 2001 (JP) ..... 2001-251783

(51) Int. Cl.[7] ..... F02N 17/00
(52) U.S. Cl. ..... 123/179.4
(58) Field of Search ..... 123/179.4, 179.3; 290/38 R, 38 E

(56) References Cited

U.S. PATENT DOCUMENTS 6,351,104 B1 * 2/2002 Koelle et al. ..... 322/22
6,608,394 B2 * 8/2003 Osada et al. ..... 290/31

FOREIGN PATENT DOCUMENTS

DE 198 38 973 A1 3/2000
JP A 11-122824 4/1999

OTHER PUBLICATIONS

Article from Automotive Electronics; "Starter Generator"; Offprint from ATZ/MTZ; Jan. 2000; pp. 44–46.

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

A control system of an internal combustion engine controls the starting of an internal combustion engine, which has been stopped, based on the establishment of a predetermined starting condition. The control system is provided with at least two power sources, a low-voltage power source and a high-voltage power source, a starting mechanism that is driven by the power source so as to operate the internal combustion engine, and a switching mechanism for switching between a connection, of the starting mechanism, to the low-voltage power source and a connection, of the starting mechanism, to the high-voltage power source.

8 Claims, 3 Drawing Sheets

CONTROL SYSTEM FOR INTERNAL COMBUSTION ENGINE AND METHOD

INCORPORATION BY REFERENCE

This disclosure of Japanese Patent Application No. 2001-251783 filed on Aug. 22, 2001, including the specification, drawing and abstract is incorporated herein by reference in its entirety.

BACKGROUND OF THE INVENTION

1. Field of Invention

The invention relates to a control system for automatically starting an internal combustion engine, for example, a gasoline engine, a diesel engine and the like. More specifically, the invention relates to a control system for an internal combustion engine that is equipped with a starting mechanism, which is electrically powered to crank the internal combustion engine.

2. Description of Related Art

An economy-running control or eco-run control has been known to improve the fuel efficiency of a vehicle that is driven by an internal combustion engine. The eco-run control operates to stop an internal combustion engine of a vehicle when the vehicle is in a stopped state. The eco-run control automatically stops the internal combustion engine when it determines that the vehicle will not take off immediately after the vehicle is stopped, and re-starts the internal combustion engine when it determines that a request to start the vehicle has been issued.

The eco-run control for automatically stopping and re-starting the internal combustion engine is automatically performed, irrespective of the intention of a driver or a passenger, when a vehicle is in a temporary stopped state during the running of the vehicle. Therefore, it is preferable to keep the driver or the passenger of the vehicle from sensing the stopping and re-starting of the internal combustion engine of the vehicle. When the vehicle does not timely start upon the driver's operation to cause the vehicle to take off and instead starts after a delay from the driver's operation, the driver or the passenger may experience the vehicle behavior resulting from the stopping and the re-starting of the internal combustion engine. If the driver or the passenger senses this delay, the driveability of the vehicle is reduced.

Thus, it is preferable to perform a cranking operation for re-starting the internal combustion engine of the vehicle, such as, for example, a gasoline engine or a diesel engine, which has been in a stopped state due to the eco-run control, as quickly as possible. By re-starting the internal combustion engine as quickly as possible, the time taken from establishment of the re-starting condition of the internal combustion engine until the autonomous operation of the internal combustion engine. Generally, a starter, as one type of electric motor, is used for cranking the internal combustion engine. A device disclosed in JP-A-11-122824 includes a main battery and an auxiliary battery that generates a voltage lower than that of the main battery. If the state of charge of the main battery is lower, the auxiliary battery charges the main battery to reliably drive the starter that starts the internal combustion engine.

Conventionally, it is well known that in a hybrid vehicle including an internal combustion engine and an electric motor, the internal combustion engine can be started by the electric motor that drives the vehicle. The electric motor is capable of starting the internal combustion engine faster than the case in which the internal combustion engine is started by the starter. However, the aforementioned control may require an electric motor with a greater capacity, than that of a starter, for starting the internal combustion engine. Therefore, the hybrid vehicle is provided with a high-voltage battery for the electric motor, as the driving source, in addition to an ordinary battery for the starter.

In the above-described device that is disclosed in JP-A-11-122824, the main battery is used as a power source for driving the starter and the auxiliary battery supplies the main battery with electricity only when the state of charge of the main battery is lower. Accordingly, the amount of charge required for driving the starter is kept under the level of electricity supplied from the main battery. Therefore, the time it takes to start the internal combustion engine through manual operation is substantially the same as the time it takes to automatically start the internal combustion engine through the eco-run control. This indicates the difficulty in satisfying the condition of a quick response, which is required for starting-up the internal combustion engine under the eco-run control, even when two types of batteries are employed. The internal combustion engine can always be started quickly by increasing the voltage of the main battery to be higher than that of the battery conventionally employed in the vehicle. However, this may cause the main battery to have an unnecessarily large capacity and thus, deteriorating the durability of the starter.

Further, the electric motor, serving as the driving source, is capable of starting the internal combustion engine of the hybrid vehicle for the driving operation. In this case, the start-up of the internal combustion engine by the electric motor can be performed faster than the start-up of the internal combustion engine by the starter. The aforementioned control for the start-up of the internal combustion engine may require an electric motor with a large capacity that is sufficient for driving the vehicle. Thus, the aforementioned control cannot reasonably be employed in the vehicle other than the hybrid vehicle. In particular, increased capacity of the electric motor, sufficient to run the vehicle, may increase the size of the high-voltage battery, thus increasing the weight of the vehicle body.

SUMMARY OF THE INVENTION

It is therefore an object of the invention to provide a control system capable of quickly starting an internal combustion engine independent of a manual operation while keeping the vehicle structure or the system simple.

The control system according to the invention is provided with at least two power sources of high and low voltages for a single starting mechanism for an internal combustion engine. It is configured such that the starting mechanism is connected to at least one of two types of power sources. More specifically the control system for an internal combustion engine of a vehicle is provided with at least a first power source and a second power source, the first power source generating a lower voltage than the second power source, a starting mechanism that is driven by one of the first and the second power sources to start the internal combustion engine, a switching mechanism that switches between a first position, in which the starting mechanism is connected to the first power source, and a second position, in which the starting mechanism is connected to the second power source, and a controller that controls the starting mechanism such that the internal combustion engine is started when a predetermined starting condition is established.

According to the aforementioned control system, the starting mechanism operated by cranking the internal combustion engine may be driven by one of a low-voltage power source or a high-voltage power source. When driving the starting mechanism by the high-voltage power supply portion, the output of the starting mechanism is increased so as to quickly start the internal combustion engine. As a result, a temporary delay generated when automatically starting the internal combustion engine, subsequent to the establishment of the predetermined starting condition, may be reduced as compared to when the internal combustion engine is started by the low-voltage power source. This makes it possible to eliminate or suppress a delay that can be sensed by the driver or passenger when the vehicle is started.

The controller controls the switching mechanism to switch from the first position to the second position prior to the establishment of the predetermined starting condition.

According to the aforementioned control system, when the starting condition has been established and electricity needs to be supplied to the starting mechanism, the switching mechanism has already been operating such that the starting mechanism is connected to the low-voltage power source. Therefore, even if the switching mechanism is of a contact type requiring the continuity state or contact state of the contact points to be stabilized prior to the supply of electricity, the switched contact points are stabilized and are ready to be energized when the starting condition is established. This makes it possible to reduce the time required for starting the internal combustion engine by means of the starting mechanism and thus, eliminate or suppress a delay that is sensed upon the vehicle takeoff.

The controller stops the internal combustion engine when a predetermined stopping condition is established, and controls the switching mechanism from the first position to the second position during a period between the establishment of the predetermined stopping condition and an actual stop of the internal combustion engine.

According to the aforementioned control system, the switching mechanism is operated during a period after establishment of the stopping condition until the internal combustion engine has been actually stopped, that is, while the internal combustion engine is operating. In case the switching mechanism is of a contact type and a contact noise or an abutting noise of the contact points is generated accompanied by the switching operation, the noise generated at the switching mechanism is deafened by or merged with a noise caused by operation of the internal combustion engine. Thus, the noise generated at the switching mechanism does not become conspicuous.

BRIEF DESCRIPTION OF THE DRAWINGS

Various exemplary embodiments of this invention will be described in detail with reference to the following figures, wherein.

DETAILED DESCRIPTION OF PREFERRED EMBODIMENTS

Figure 1:
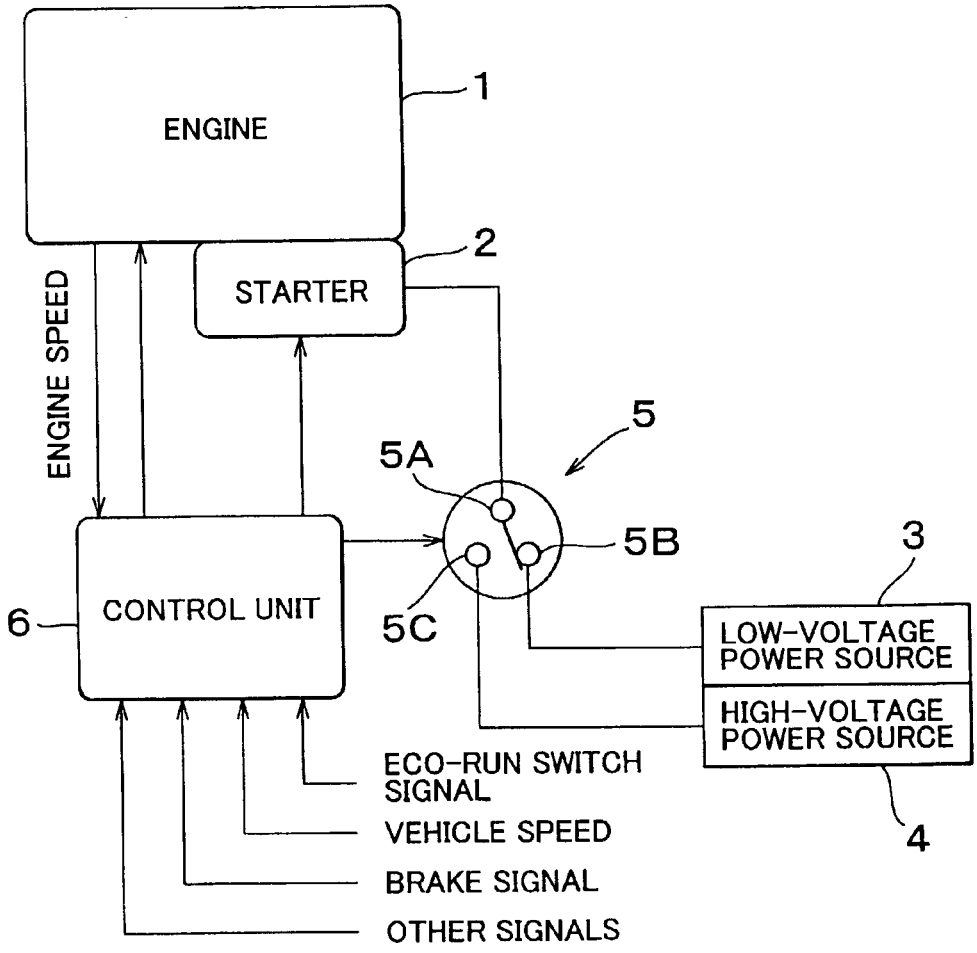
FIG. 1 is a block diagram schematically showing a control system of an internal combustion engine according to the invention.

The invention will be explained by referring to the drawings. FIG. 1 is a diagram showing a control system of an internal combustion engine according to the invention. An internal combustion engine or an engine 1 is, for example, a diesel engine or a gasoline engine that is started by a cranking operation that rotates an output shaft using an outer force. The engine 1 is further provided with a starter 2 for the cranking operation. The starter 2 may have a known structure that is mainly configured by an electric motor that is driven by one of a high-voltage power source and a low-voltage power source.

A low-voltage power source 3 and a high-voltage power source 4 are employed for driving the starter 2. Power sources 3, 4 serve as terminals, each having a different output voltage, for the batteries that are separately provided or for a single battery. The low-voltage power source 3 serves as a 12V power source used in an ordinary vehicle, and the high-voltage power source 4 serves as a power source of approximately 36 V.

The control system has a relay 5 that switches a contact between a first position, in which the starter 2 is connected to the power source 3, and a second position, in which the starter 2 is connected to the power source 4. That is, a contact point 5A of the starter 2 is connected either to a contact point 5B of the low-voltage power source 3 or a contact point 5C of the high-voltage power source 5, by which electricity is supplied to the starter 2.

The control system according to the invention is provided with a control unit 6 for controlling the engine 1, the starter 2, and the relay 5. The control unit 6 constitutes an electronic control unit (ECU) mainly configured by a microprocresser, in which various computations are performed based on the input data and a predetermined control signal is generated. The ECU receives various signals, for example, a signal indicating an engine speed, a signal from an eco-run switch (not shown), a signal indicating a vehicle speed, a signal indicating an ON/OFF state of a brake of the vehicle, a signal indicating a water temperature of the engine, and a signal indicating a voltage of the power source or the like. The ECU generates control signals, for example, a control signal for stopping the engine 1, a control signal for starting the engine 1, a control signal for operating the starter 2, and a control signal for switching the relay 5 or the like.

The description of the control signal, for the engine 1, generated by the control unit 6 will be described. By turning the eco-run switch ON, the eco-run control is brought into an operable state. The eco-run control automatically stops an operation of the engine 1 when it is determined that a predetermined vehicle-stop condition is established, that is, the engine is temporarily stopped. Subsequently, in the aforementioned state, the engine 1 is automatically started upon the establishment of the engine-start-up condition. When it is determined that the vehicle is brought into a stopped state, that is, when the vehicle speed is equal to or less than a predetermined value, and the signal indicating the ON state of the brake is generated, it is determined that the engine stop condition is established. Thus, the engine stop signal is generated. Where the diesel engine is employed as the engine 1, the quantity of intake air is reduced by closing the intake throttle valve, and the start-up control signal allows an intake operation by opening the intake throttle valve as well as the cranking operation by the starter 2. As a result, the fuel is injected from the cylinder in the expansion stroke and subsequent ones.

Further, the control signal for the starter 2 allows the starter 2 to be turned ON/OFF at a predetermined timing. In particular, the control signal for the starter 2 refers to one for turning the starter 2 ON and OFF at a predetermined timing.

In addition, the control signal for the relay 5 allows the connection between the starter 2 and the low-voltage power source 3 in the normal state where the control for automatic stop and automatic start-up is not controlled. On the contrary, in the eco-run control operation for automatic stop and start-up of the engine 1, the control signal for the relay 5 may become a control signal for connecting the starter 2 to the high-voltage power supply 5.

Figure 2A:
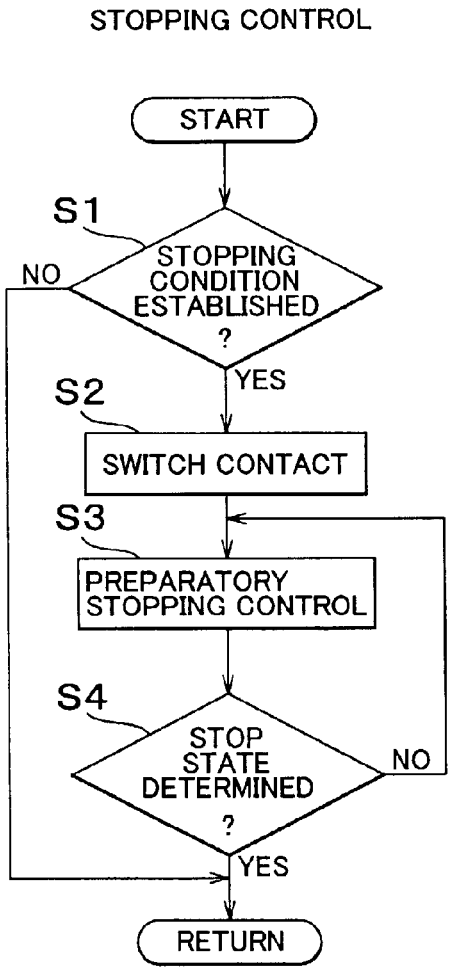
FIG. 2A and FIG. 2B are flowcharts showing an example of a control routine performed by the control system.

Control routines of the control unit 6 for stopping and starting of the engine will be described referring to FIG. 2A and FIG. 2B. In step S1 of FIG. 2A, it is determined whether the engine stop condition is established. In accordance with the engine stop condition, the engine 1 is automatically stopped under the eco-run control. When the vehicle speed is zero and the brake is in an ON state, it is determined that the engine stop condition is established.

If NO is obtained in step S1, the control routine returns without performing a control. On the contrary, if YES is obtained in step S1 upon the establishment of the engine stop condition, the relay 5 is operated to switch the contact point between the starter and the low-voltage power source to a contact point between the starter and the high-voltage power source 4 such that the starter 2 is connected to the high-voltage power source 4. More specifically, the relay 5 is operated to switch the contact point such that the contact point 5A of the starter is connected to the contact point 5C of the high-voltage power source. The aforementioned switching operation is performed to re-start the engine 1 that has been stopped.

When the switching operation is performed, the engine 1 is still operating, and noise resulting from the engine operation still exists. Therefore, the sound caused by the operation of switching the contact is not sensed by the vehicle operator or the passenger because of the existing noise resulting from the engine operation.

Then, in step S3, a control for stopping of the engine 1 is executed such that the engine 1 is smoothly stopped without causing vibration. In order to smoothly stop a diesel engine, the intake air quantity to the cylinder is reduced by closing the intake throttle valve or EGR valve (control valve for recirculation of exhaust gas) so as to stop the fuel supply. This makes it possible to gradually decrease the speed of the engine 1.

Next, in step S4, it is determined whether the engine 1 has been stopped in accordance with the signal indicating the engine speed. If NO is obtained in step S4, the process returns to step 3 in which the control for preparing the engine stop is executed as described above. On the contrary, if YES is obtained, the process ends.

Figure 2B:
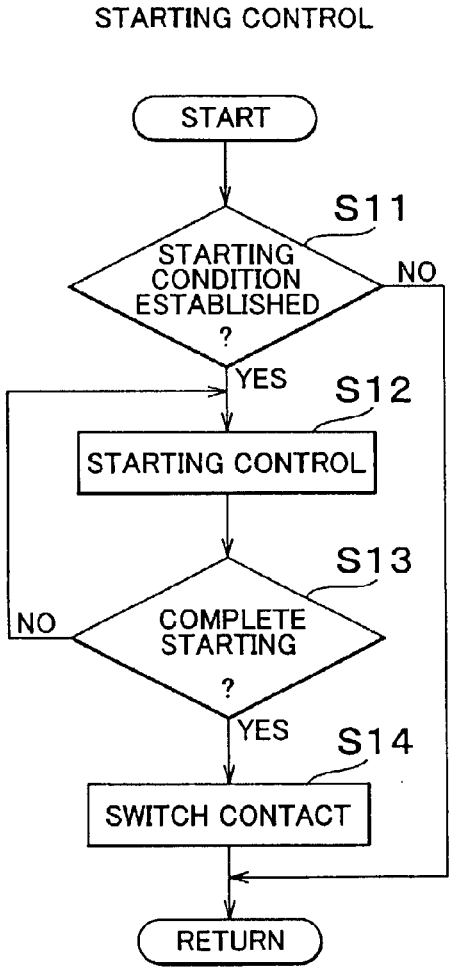

In order to re-start the engine 1 that has been automatically stopped under the eco-run control, it is determined whether the start-up condition is established in step S11, as shown in FIG. 2B. It is determined that the start-up condition is established when the brake pedal (not shown) is released to bring the brake into an OFF state.

When NO is obtained in step S11, the process returns. Meanwhile when YES is obtained in step S11, the process proceeds to step S12 in which the start-up control is executed such that the engine 1, that has been in an OFF state, is caused to have autonomous rotating. In the case where the diesel engine is employed, the engine is driven by opening the intake throttle valve to supply electricity to the starter 2. The starter 2 starts cranking the engine as well as the fuel supply to the engine 1.

In this case, since the relay 5 has switched the connection of the starter 2 to the high-voltage power source 4, and the respective contact points are stable, no arc or spark is generated by the supply of electricity. As the starter 2 is connected to the high-voltage power source 4 via the relay 5, the resultant torque is increased. Accordingly, the speed of the engine 1 is sharply increased for the purpose of autonomous revolution. In other words, the engine 1 can be quickly started through cranking.

In step S13, it is determined whether the engine has been started based on the engine speed. Alternatively, start-up of the engine can be determined based on the time that has elapsed from the time of driving the starter 2.

When NO is obtained in step S13, the process proceeds to step S12 in which the start-up control is continued. On the contrary, when YES is obtained in step S13, that is, the start-up of the engine has been completed, the process proceeds to step S14. In step S14, the contact, for connection between the starter and the power source, is switched. More specifically, the relay 5 is operated to switch the connection of the starter 2 to the low-voltage power source 3 because, in the exemplary embodiment, the low-voltage power source is regularly used under the eco-run control except during the start-up of the engine 1 under the eco-run control. When the engine 1 is manually started, the low-voltage power source supplies electricity to the starter 2 such that the engine 1 is cranked. The high-voltage power source is used only when the engine 1 is automatically started under the eco-run control.

Figure 3:
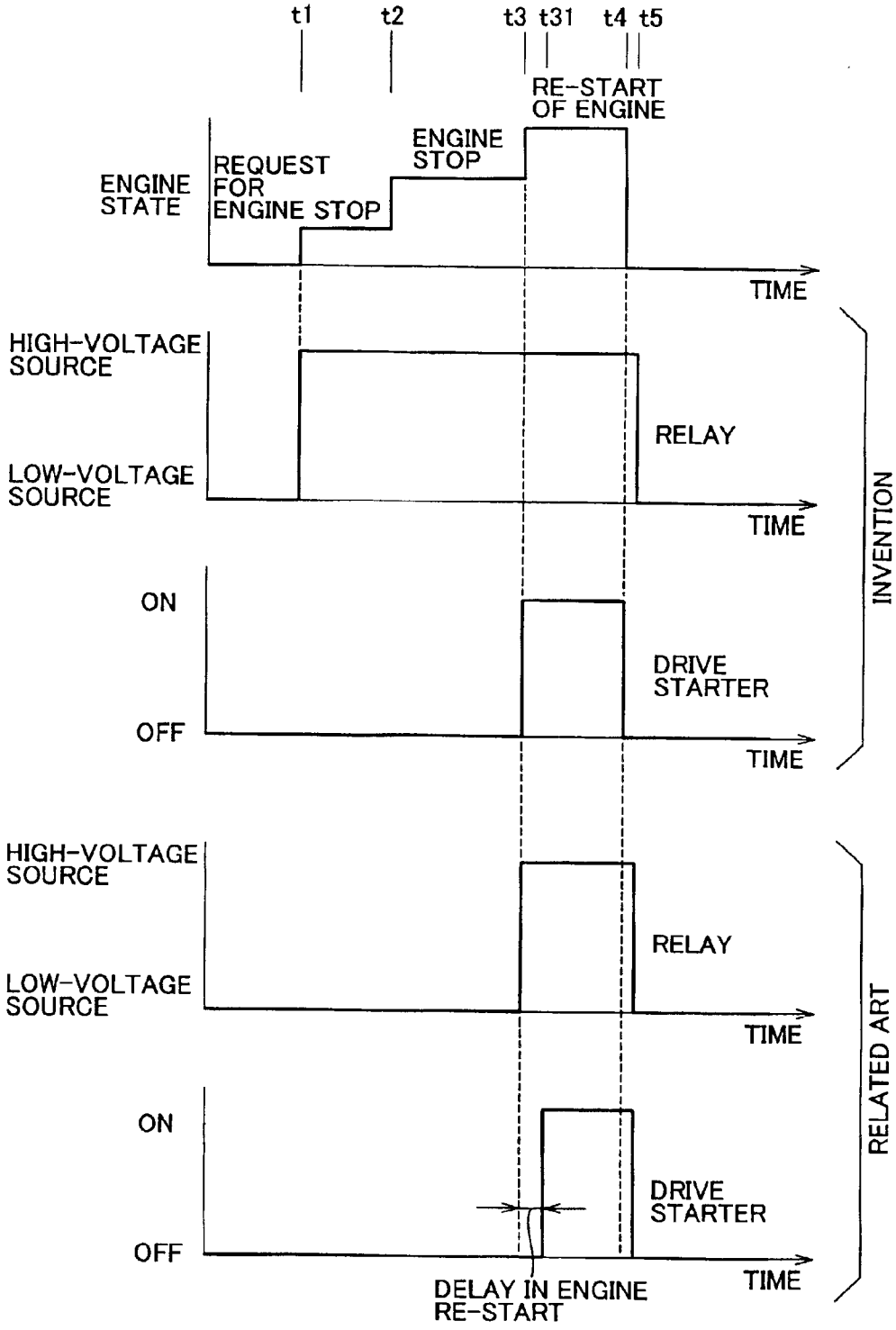
FIG. 3 is a time chart showing the state of the vehicle behavior according to the systems of this invention in comparison with that of the related art when the control routine shown in FIGS. 2A and 2B is executed.

FIGS. 3A and 3B are time charts obtained when the aforementioned control is executed in comparison with those obtained when the control as related art is executed. At a point t1 at which a time t1 has elapsed from the time when the vehicle speed becomes zero, it is determined that the engine-stop condition is established. Then, the relay 5 is activated to switch the contact of the starter 2 to the high-voltage power source. As the engine is operating and noise resulting from the engine operation is generated, at the moment of switching of the contact, the sound caused by the switching of the contact, cannot be sensed by the vehicle operator or the passenger. As the contact is not energized yet, no ark or spark is generated between the contacts.

Further, after execution of the preparatory control for stop of the engine, the engine 1 is stopped at a point t2.

When the brake is brought into an OFF state, it is determined that the engine start condition is established at a point t3. Then, the request for re-start of the engine 1 is issued, and the starter 2 is driven. In this case, as the relay 5 has already switched the contact, electricity is immediately supplied to the starter 2, and the engine 1 is cranked. At a subsequent point t4, start-up of the engine 1 is completed, and the starter 2 is stopped. Immediately after the point t4, that is, at a point t5, the relay 5 switches the contact of the starter to the low-voltage power source.

On the contrary, in the control in the related art, the relay 5 is operated to switch the contact at point t3 when the request for re-starting of the engine 1 is issued. Therefore, it becomes possible to supply electricity to the starter 2 at a point t31 when the state of the contacts becomes stable. As a result, the start-up of the engine 1 is delayed for the time period from the point t3 to the point t31. This may cause the vehicle operator or the passenger to experience a delay.

As described above, each of the low-voltage power source 3 and the high-voltage power source 4 constitutes the power source. The starter 2 serves as the engine starting mechanism, and the relay 5 serves as the contact switching mechanism. Further the control unit 6 and the above-described steps S2 and S 14 executed by the control unit 6 serve to switch the contact from one position to another.

It is noted that the invention is not limited to the aforementioned embodiment. Therefore, the invention is applicable to any type of the internal combustion engine for burning the fuel gas as well as the diesel engine or the gasoline engine so long as the cranking operation is required for starting the engine. Any type of power source, for example, at least one battery or a capacitor, may be employed so long as electric power is generated. In addition to the starter, the engine start-up mechanism may be configured as any type of device that can be used for cranking the engine.

The switching mechanism is not limited to the mechanism of contact type, but of any type so long as it selectively connects the engine starting mechanism to at least one of the low-voltage power source or the high-voltage power source. The invention may be structured to automatically start the internal combustion engine upon establishment of a predetermined condition. Therefore, the internal combustion engine may be manually stopped instead of automatically stopped upon establishment of the predetermined engine-stop condition.

As described above, according to the systems of this invention, when starting the internal combustion engine upon establishment of a predetermined starting condition, the starting mechanism is driven by the high-voltage power source so as to start the internal combustion engine with a large driving force. This enables quick starting of the internal combustion engine, and therefore it is possible to reduce a delay that occurs when the internal combustion engine is automatically started after establishment of the starting condition in comparison to when the internal combustion engine is started by means of the low-voltage power source. Thus, the so called hesitation feeling or delay, when the vehicle is made to take off, may be eliminated or suppressed. In addition, since the high-voltage power source is used only when starting the internal combustion engine after a predetermined starting condition has been established, a decrease in the durability of the starting mechanism may be prevented. In addition, only a single starting mechanism is required, and high capacity is not required for a high-voltage power source. Therefore, it is possible to avoid the entire configuration of the system from becoming particularly complicated or large.

According to a preferred form of the aspect of the invention, at a time when electricity needs to be supplied to the starting mechanism after the starting condition has been established, the switching mechanism has already been switched and the starting mechanism has been connected to the high-voltage power source. Therefore, there are some cases where the switching mechanism is a contact type mechanism and continuity state or contact state of contact points needs to be stabilized prior to being energized. Even in these cases, the already-switched contacts have been stable and are ready to be energized at a point when the starting condition has been established. Therefore, a time required for starting the internal combustion engine by means of the starting mechanism may be reduced, resulting in eliminating or suppressing a so called hesitation feeling when the vehicle is made to take off.

Further, according to another preferred form of the aspect of the invention, the switching mechanism is subject to the switching operation during a period after the stopping condition has been established until the internal combustion engine actually stops, that is, while the internal combustion engine is operating. Therefore, even when the switching mechanism is a contact type mechanism and contact noise or abutting noise of the contact points are generated accompanied by the switching operation, the noise generated at the switching mechanism is deafened by a noise caused by operation of the internal combustion engine. Or, both noises are merged so as to make the noise generated at the switching mechanism less conspicuous, thereby deterioration of ride comfort of the vehicle is avoided.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A control system for an internal combustion engine of a vehicle, comprising:

at least a first power source and a second power source, the first power source generating a lower voltage than the second power source;

a starting mechanism that is driven by one of the first and the second power sources so as to start the internal combustion engine; and a switching mechanism that switches between a first position in which the starting mechanism is connected to the first power source, and a second position in which the starting mechanism is connected to the second power source; and a controller that controls the starting mechanism such that the internal combustion engine is started when a predetermined starting condition is established, wherein the controller controls the switching mechanism to switch from the first position to the second position prior to the establishment of the predetermined starting condition.

2. The control system according to claim 1, wherein the controller controls the switching mechanism to switch from the second position to the first position after completion of the start of the internal combustion engine.

3. A control system for an internal combustion engine of a vehicle, comprising:

at least a first power source and a second power source, the first power source generating a lower voltage than the second power source;

a starting mechanism that is driven by one of the first and the second power sources so as to start the internal combustion engine; and a switching mechanism that switches between a first position in which the starting mechanism is connected to the first power source, and a second position in which the starting mechanism is connected to the second power source; and a controller that controls the starting mechanism such that the internal combustion engine is started when a predetermined starting condition is established, wherein the controller:

stops the internal combustion engine when a predetermined topping condition is established; and controls the switching mechanism from the first position to the second position during a period between the establishment of the predetermined stopping condition and an actual stop of the internal combustion engine.

4. The control system according to claim 3, wherein the controller controls the switching mechanism to switch from the second position to the first position after completion of the start of the internal combustion engine.

5. A control method for controlling an internal combustion engine of a vehicle, comprising the steps of:

driving a starting mechanism by one of a first power source and a second power source, the first power source generating a lower voltage than the second power source;

switching a position between a first position in which the starting mechanism is connected to the first power source, and a second position in which the starting mechanism is connected to the second power source; and controlling the starting mechanism such that the internal combustion engine is started when a predetermined starting condition is established, wherein the switching mechanism is controlled to switch from the first position to the second position prior to the establishment of the predetermined starting condition.

6. The control method according to claim 5, wherein the switching mechanism is controlled to switch from the second position to the first position after completion of the start of the internal combustion engine.

7. A control method or controlling an internal combustion engine of a vehicle, comprising the steps of:

driving a starting mechanism by one of a first power source and a second power source, the first power source generating a lower voltage than the second power source;

switching a position between a first position in which the starting mechanism is connected to the first power source, and a second position in which the starting mechanism is connected to the second power source;

controlling the starting mechanism such that the internal combustion engine is started when a predetermined starting condition is established;

stopping the internal combustion engine when a predetermined stopping condition is established; and controlling the switching mechanism from the first position to the second position during a period between the establishment of the predetermined stopping condition and an actual stop of the internal combustion engine.

8. The control method according to claim 7, wherein the switching mechanism is controlled to switch from the second position to the first posit on after completion of the start of the internal combustion engine.

* * * * *